US008561229B2

(12) United States Patent
Regan et al.

(10) Patent No.: US 8,561,229 B2
(45) Date of Patent: Oct. 22, 2013

(54) BAFFLE BOX COMFORTER

(75) Inventors: Laura A. Regan, Seattle, WA (US); Tamara P. Soreano, Shoreline, WA (US)

(73) Assignee: Pacific Coast Feather Co., Seattle, WA (US)

( * ) Notice: Subject to any disclaimer, the term of this patent is extended or adjusted under 35 U.S.C. 154(b) by 0 days.

(21) Appl. No.: 12/553,885

(22) Filed: Sep. 3, 2009

(65) Prior Publication Data

US 2011/0047699 A1 Mar. 3, 2011

(51) Int. Cl.
*A47G 9/00* (2006.01)

(52) U.S. Cl.
USPC ..... 5/502; 5/486; 5/482

(58) Field of Classification Search
USPC ..... 5/502, 690, 486, 485, 691; 428/166, 428/178; 112/420, 440
See application file for complete search history.

(56) References Cited

U.S. PATENT DOCUMENTS

| | | | | |
|---|---|---|---|---|
| 1,893,548 | A | 1/1933 | Hardy | |
| 3,619,336 | A * | 11/1971 | Hughes | 5/502 |
| 3,635,785 | A * | 1/1972 | Hughes | 5/502 |
| 4,115,610 | A | 9/1978 | Wortman | |
| 4,426,945 | A | 1/1984 | A-Yan | |
| 5,023,970 | A * | 6/1991 | Tesch | 5/502 |
| 5,187,825 | A * | 2/1993 | Tesch | 5/502 |
| 5,199,121 | A | 4/1993 | Payne | |
| 5,299,333 | A * | 4/1994 | Pedersen et al. | 5/502 |
| 5,987,669 | A | 11/1999 | Leggett et al. | |
| 6,961,970 | B2 * | 11/2005 | Pedersen | 5/502 |
| 7,045,191 | B2 | 5/2006 | Huntley | |
| 7,080,421 | B1 | 7/2006 | Delfs | |
| 7,818,834 | B2 * | 10/2010 | Li | 5/413 R |
| 7,870,623 | B2 * | 1/2011 | Judd | 5/502 |
| 2008/0201846 | A1 | 8/2008 | Soreano | |

* cited by examiner

*Primary Examiner* — Peter M Cuomo
*Assistant Examiner* — Brittany Wilson
(74) *Attorney, Agent, or Firm* — Jensen & Puntigam, P.S.

(57) ABSTRACT

The comforter includes two substantially identical fabric sections, with lines of attachment between them defining edges of a plurality of side-by-side parallel channels. Baffle members are positioned within each channel, attached to one edge of each channel, but not extending all the way to the opposing edge thereof, wherein the baffle members in any given channel are positioned in a staggered relationship relative to the position of baffle members in adjacent channels.

5 Claims, 1 Drawing Sheet

BAFFLE BOX COMFORTER

TECHNICAL FIELD

This invention relates generally to comforters, and more specifically concerns a comforter having multiple channels with baffle elements positioned within the channels.

BACKGROUND OF THE INVENTION

Baffle box-type comforters, in which baffles are positioned at selected spots within channel portions of the comforter to prevent movement of fill within the channels, are generally known. However, in a true baffle box comforter, the baffles are positioned in registry laterally across the comforter, when the channels run longitudinally, or vice versa. This arrangement does have some disadvantages, among them being the presence of cold spots or cold lines in the comforter, particularly in the regions where the baffles are secured within the channels.

It is desirable that a comforter have a construction which minimizes cold spots as well as being effective in preventing flow of filling within the channels. Such a comforter must also be convenient to fill, with either synthetic or natural fill.

SUMMARY OF THE INVENTION

Accordingly, the new baffle box comforter comprises: two substantially identical fabric sections; a plurality of lines of attachment between the fabric sections, defining edges of a plurality of side-by-side channels; and baffle members positioned within each channel, attached to one edge thereof, the position of baffle members in each channel, respectively, being staggered relative to the position of baffle members in adjacent channels.

BEST MODE FOR CARRYING OUT THE INVENTION

Figure 1:
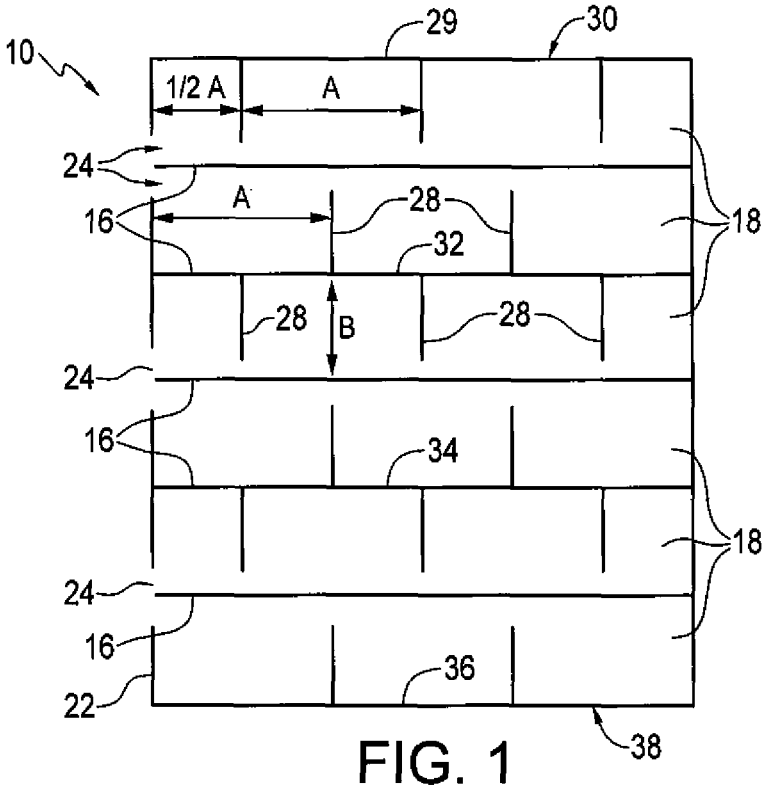
FIG. 1 is a top view of a comforter described therein without a border region.
Figure 1A:
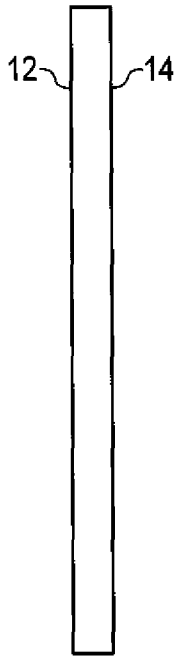
FIG. 1A is a side elevational view of the comforter of FIG. 1.

FIG. 1 shows a comforter 10, which includes upper and lower fabric sections 12, 14 which are substantially identical. The dimensions of the fabric sections will depend upon the desired size of the comforter. For instance, for a queen size bed, the comforter dimensions are 88 inches wide by 90 inches long. Typically, the fabric sections 12, 14 are selected from a variety of fabrics, such as cotton or similar material. The fabric sections are sewn together around their peripheries and then along lines 16-16 to define successive channels 18-18 within the comforter, extending for the length of the comforter or the width thereof. Channels 18-18 are typically parallel.

In the embodiment shown, the distance between adjacent sewing lines 16-16 (channel lines) is 11 inches, although this can be varied, depending upon the particular design of the comforter. While channels 18 are created in the embodiment shown by lines of sewing, other attachment means can be used to define the channel lines and hence the channels. In addition, baffles can be used to define the channel lines, with the height of the baffles depending upon the particular comforter design. Along one edge 22 of the comforter are a plurality of blow openings 24, one for each two adjacent channels in the embodiment shown. Typically, each blow opening will extend 3 inches on both sides of alternate channel lines. This is to permit ease of blowing the filling into the channels.

Positioned within each channel, extending from alternate channel lines located on opposing sides of those channel lines bisecting the blow openings, are a plurality of baffles 28-28. In the embodiment shown, there are three baffles in some channels, while alternate channels have two baffles. The number of baffles in the various channels can, of course, vary. As indicated in the embodiment shown, the baffles 28 extend from alternating sides of successive channels, i.e. from alternating channel lines. For instance, in FIG. 1, baffles 28 extend in an alternating fashion in opposing directions from channel line 29 at one end 30 of the comforter, from channel lines 32 and 34 in the mid-region of the comforter and from channel line 36 at the other end 38 of the comforter. The baffles do not extend all the way from their attachment points at one channel line across the channel to an opposing channel line. Typically, there is a 3-inch gap between the free ends of the baffle members and the opposing channel line.

The baffle members 28 are secured along the lengths thereof to the upper and lower fabric sections, such that they are not free to move within the channels. The baffle members, as shown in the drawings, are characterized such that the position of the baffle members in one channel are staggered relative to the position of the baffle members in adjacent channels. The baffles in each channel in the embodiment shown are positioned approximately midway between two adjacent baffles in the adjacent channel or channels. The use of three baffles in one channel and two baffles in adjacent channels, for instance, permits such an arrangement. While it is preferred that the baffles in each channel are midway between the baffles in the adjacent channel or channels, the baffles can be positioned in other arrangements as well, i.e. at some point other than midway. Also, while it is preferred that the spacing between adjacent channels is the same throughout the comforter, it should be understood that the spacing could vary within the individual channels themselves or vary from channel to channel. In the embodiment shown, the spacing dimension "A" is 17 inches, while dimension "B" is 11 inches. These dimensions can vary.

The baffles in the channels define "boxes" across the comforters and along the length of the comforter. The number of boxes in the width and length dimensions will vary, depending on the size of the comforter. Typically, the number of boxes in the width dimension will vary between 4 and 6, while the length dimension will vary between 6 and 8, although it could be the same, e.g. 8, for all sizes of comforters.

The staggered arrangement of the baffles results in a significant reduction in cold spots throughout the comforter, thereby increasing the overall comfort of the user. After the comforter is filled, blow openings 24-24 are sewn closed and the comforter is complete. The fill can vary, comprising both synthetic fill, such as polyester, or natural fill, such as feathers and down, or a combination thereof.

Figure 2:
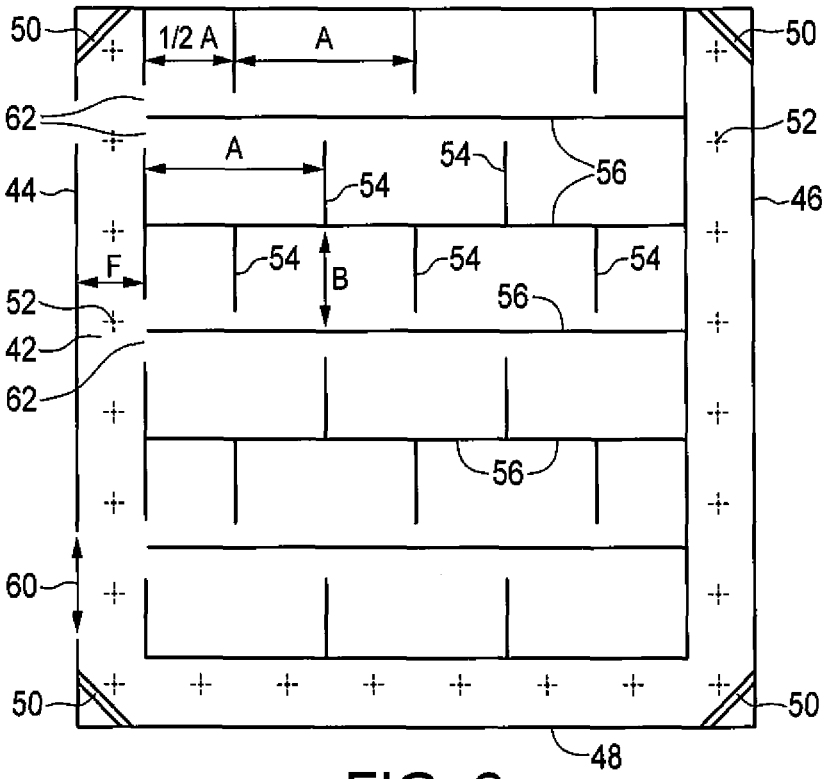
FIG. 2 is a top view of the comforter of FIG. 1, with a border region.

FIG. 2 shows an alternative embodiment, generally similar to that of FIG. 1, with the addition of a border region 42 along two sides 44 and 46 and the foot end 48 of the comforter. Corner loops 50 can be provided at each corner of the comforter for convenient attachment to a mattress. In the embodiment shown, the width of the border region along the sides is approximately 12 inches, while the border region along the foot end is also typically approximately 12 inches. One and one-half inch tacks 52 are sewn through the two fabric sections along the border region. In the embodiment shown, there are 10 inches between successive tacks 52-52. As with the embodiment of FIG. 1, the number of staggered boxes, defined by baffles 54 and the channel lines of sewing 56, will vary depending upon the size of the comforter, for instance between 2 and 5 in the width dimension and between 6 and 8 in the length dimension, although the length dimension could have the same number of boxes, e.g. 7, for all sizes. The embodiment of FIG. 2 includes a blow opening 60 for the border, in addition to the several blow openings 62 in the baffle boxes with staggered baffles.

Hence, a new comforter arrangement has been shown, which is a substantial variation of a traditional baffle box comforter, in which baffles are provided at staggered positions between adjacent channels to provide increased comfort by reduction of cold lines and cold spots throughout the comforter. Further, the baffles are positioned and attached to the channel lines in such a manner as to permit convenient filling of the comforter prior to closure of the blow openings to complete the comforter.

Although a preferred embodiment has been disclosed for purposes of illustration, it should be understood that various changes and modifications and substitutions could be made in the preferred embodiment without departing from the spirit of the invention as defined by the claims which follow:

What is claimed is:

1. A baffle box comforter, comprising:

two substantially identical fabric sections;

a plurality of lines of attachment between the fabric sections, defining edges of a plurality of side-by-side channels wherein the channels are of equal width; and a baffle member assembly comprising substantially straight baffle members positioned within each channel, with one end only thereof attached to one edge thereof, wherein the baffle members extend more than 50% but not all the way across the channel in which they are positioned, permitting fill to be blown into all of the boxes defined by the baffle members in each channel, wherein baffle members in selected adjacent channels are attached to the same channel edge, extending in opposing directions in their respective channels, the position of baffle members in each channel, respectively, being staggered relative to the position of baffle members in adjacent channels, wherein one set of channels includes at least two baffle members and wherein an alternating set of channels includes one additional baffle member, such that there are more baffle members in the alternating set than in the one set, and wherein the baffle members in the one set of channels are positioned approximately halfway between adjacent baffles in the alternating set of channels.

2. The comforter of claim 1, wherein the lines of attachment between the fabric sections are continuous along the length thereof, thereby defining closed channels between opposing ends of the comforter.

3. The comforter of claim 1, wherein the lines of attachment are sewn lines.

4. The comforter of claim 1, wherein the lines of attachment include sections of fabric which are attached to the fabric sections along opposing edges thereof.

5. The comforter of claim 1, wherein the baffle members are attached along the entire upper and lower edges thereof to the fabric sections.

* * * * *